United States Patent [19]

LeBrun et al.

[11] 4,026,557

[45] May 31, 1977

[54] BOARD GAME APPARATUS

[76] Inventors: Paul Antony Hammet LeBrun, The Wilderness, 284 Wolverhampton Rd. West, Bentley, Walsall, Staffordshire; Nigel Gordon Backhurst, 7 Lime Road, Wednesbury, West Midlands, both of England

[22] Filed: Oct. 7, 1975

[21] Appl. No.: 620,315

[30] Foreign Application Priority Data

Oct. 8, 1974 United Kingdom ..... 43476/74

[52] U.S. Cl. ..... 273/134 D; 273/131 KN

[51] Int. Cl.[2] ..... A63F 3/00

[58] Field of Search ..... 273/131, 134

[56] References Cited

UNITED STATES PATENTS 3,776,554 12/1973 Capablanca et al. ..... 273/131 AB

*Primary Examiner*—Delbert B. Lowe

*Attorney, Agent, or Firm*—Lowe, King, Price & Markva

[57] ABSTRACT

A game apparatus comprises a board and playing pieces. The pieces comprise two differently colored sets. The board comprises a game zone having paths defined thereon and a central zone within the game zone. There are three sets of paths. A first set includes at least five endless paths in an expanding series from an inner endless path of the series to an outer endless path of the series. A second set includes at least five direct paths which extend directly outwards from the inner endless path to the outer endles path so that points of intersection are defined where the direct paths intersect the endless paths. A third set of at least five oblique paths form an expanding concentric series in which each path extends obliquely outwards beginning at one of the points of intersection between the inner endless path and a direct path to one of the points of intersection between the outer endless path and a direct path. Consequently, all of the endless paths are linked together with an equal number of direct paths at respective points of intersection. The paths are such as to permit the playing pieces to be placed on or at points of intersection so that a game may be played according to rules for moving the pieces.

20 Claims, 4 Drawing Figures

BOARD GAME APPARATUS

BACKGROUND OF THE INVENTION

This invention concerns apparatus for playing a game of skill or skill and chance.

An object of the invention is to provide improved apparatus comprising a board and pieces such that the pieces may be moved, in a sequence of moves, in various directions along substantially continuous paths.

SUMMARY OF THE INVENTION

According to the invention, the game apparatus comprises a board and playing pieces. The playing pieces comprise two differently colored sets and the board comprises a game zone having paths defined thereon and a central zone within the game zone. The paths include three sets of paths. A first set includes at least five endless paths in an expanding series from an inner endless path of the series to an outer endless path of the series. A second set includes at least five direct paths which extend directly outwards from the inner endless path to the outer endless path so that points of intersection are defined where the direct paths intersect the endless paths. The third set includes at least five oblique paths each of which extends obliquely outwards beginning at one of the points of intersection between the inner endless path and a direct path to one of the points of intersection between the outer endless path and a direct paths to link all the endless paths with an equal number of direct paths at respective points of intersection. The oblique paths extend outwardly to successive points of intersection between the endless paths and the direct paths. The paths are such as to permit the pieces to be placed at or on points of intersection whereby to permit a game to be played according to rules for moving the pieces. The rules are characterized by the inner endless path being considered to be adjacent to the outer endless path so that a piece moved inwardly beyond the inner endless path on a direct or oblique path will next arrive at the outer endless path and vice versa. Consequently, the direct and oblique paths are each effectively endless for the purpose of the games.

It will be readily appreciated that the board and paths are a two-dimensional diagrammatical representation of the surface of an endless body, e.g., a torus, having equivalent oblique, e.g., spiral, and endless, e.g., circular, paths thereon of a continuous nature.

Another feature of the apparatus is directed to the use of a second set of oblique paths. The oblique paths of one set extend outwardly clockwise and the oblique paths of the other set extend outwardly anticlockwise. The oblique paths of each set extend outwardly to successive points of intersection between the endless paths and the direct paths.

The interpath spacing between paths of each set may be similar so that the game zone is symmetrical, and the game zone is preferably circular so that the endless paths are circular, the direct paths are radial, and the oblique paths are substantially spiral.

Alternatively some of the interpath spacings between paths of one or more of the sets may be varied so that the game zone is elongate, e.g., oval.

The game zone may be of polygonal form, said paths being linear or comprising linear portions.

The number of paths of each set is preferably between six and 11.

The paths of each set are preferably distinguished from the paths of each other set by visual characteristics, such as color, density, width, shading or pattern, or any combination thereof.

The intersection points are each preferably represented by an area sufficient to enable one of said pieces to be placed thereon.

There are preferably nine paths, e.g., circles, radii and spirals, in each set, the pieces being movable by a maximum distance represented by a move of five intersection points per piece per move.

The pieces may comprise two differently colored sets of similar men together with two sets of variously charactered main pieces colored to match the sets of men. The men are limited to moves of one intersection point and the main pieces are variously movable by various respective numbers of intersection points per move, along respective ones or combinations of paths.

The apparatus may include dice or other means to select a random number or numbers, which may be used to determine the number of pieces which may be moved or the number of intersection points by which a particular piece may be moved per move.

The board may be of circular or elongate form and provided with recesses to store the pieces, and a virtual or supplementary endless path may be provided to repeat the inner path of the set around the outer path of the set outside the game zone to facilitate path and relieve congestion at the inner path.

BRIEF DESCRIPTION OF DRAWINGS

The invention will be described further, by way of example, with reference to the accompanying drawings, wherein.

DESCRIPTION OF SPECIFIC EMBODIMENTS

Figure 1:
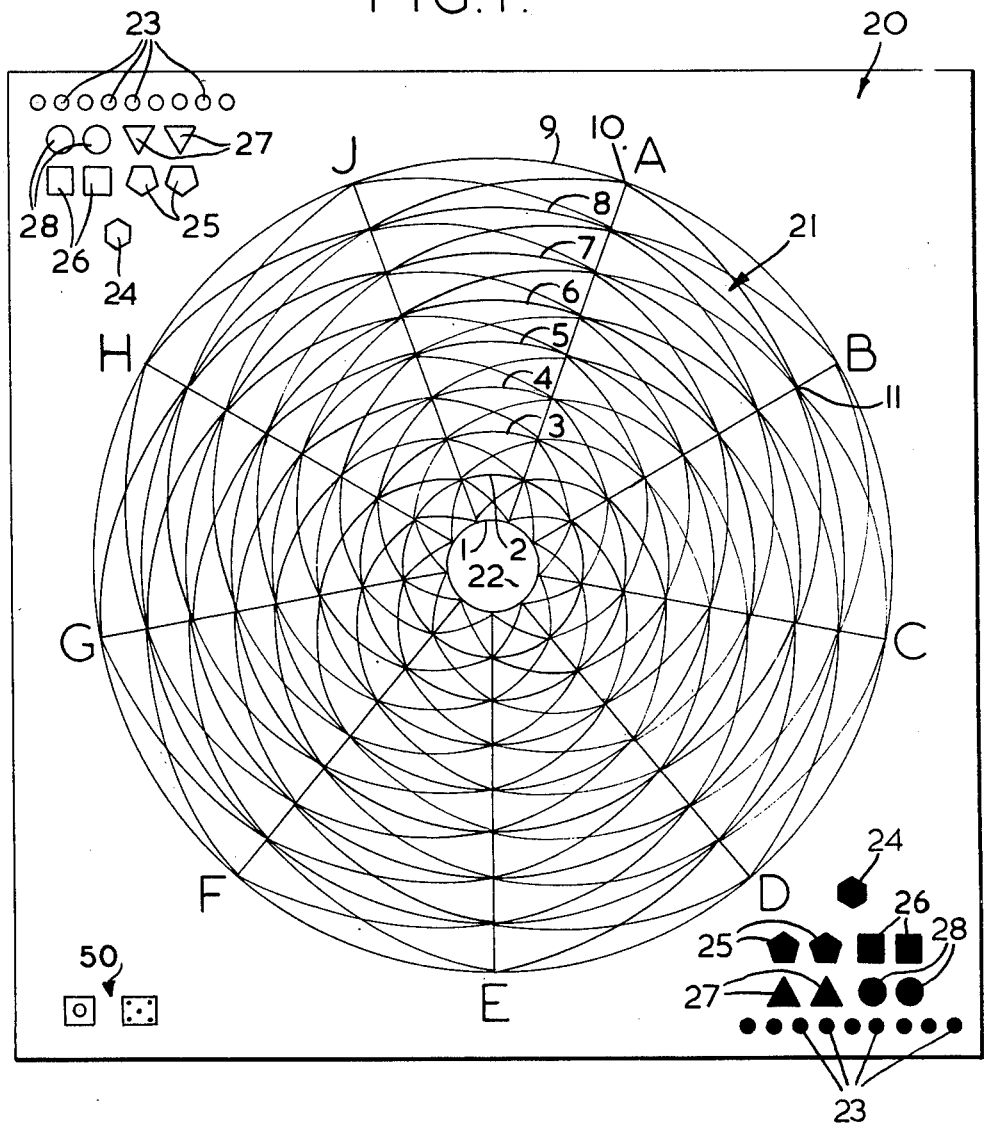
FIG. 1 shows a diagrammatical representation of a board of the apparatus of the invention.
Figure 2:
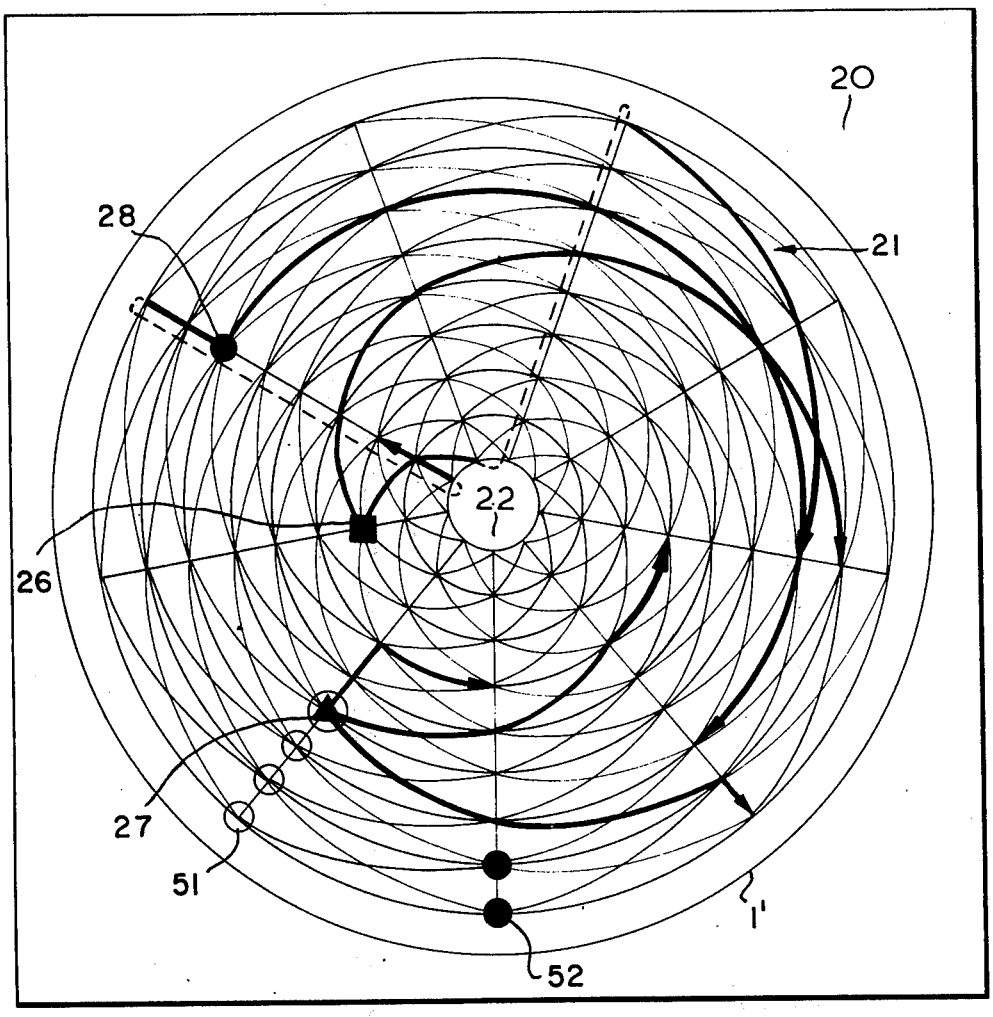
FIG. 2 shows diagrammatically some moves of the pieces of the apparatus on the board.

Referring to FIG. 1, the board 20 is marked so as to define a game zone 21 having paths which are represented diagrammatically by lines in the figure, and which comprise a set of nine endless paths or circles number 1 to 9, a set of nine direct paths or radii lettered A to J (omitting I) and two sets of nine oblique paths or spirals, one set extending clockwise and one anticlockwise in an outward direction, and which paths meet at eighty-one intersection points. Each intersection point may be denoted by the radial and circular paths meeting thereat, and said paths can be identified by their geometrical forms, e.g., the point 10 can be referred to as A9, (radius A, circle 9), and a move from this point to the point 11, referred to as B8, can be called A9-B8. The spacings between the circles and between the radii are symmetrical. Within the game zone 21 is a central zone 22. As noted herein, the inner endless path 1 may be repeated outside the game zone 21 as a supplementary endless path 1' as indicated in FIG. 2.

The apparatus includes pieces which comprise two differently colored, e.g., black and white, sets of nine identical small counters or men 23, and two sets of nine main pieces colored to match the men. Each set of main pieces comprises short bodies of characteristic cross sections which include a hexagon 24, two pentagons 25, two squares 26, two triangles 27 and two circles 28; the pieces being so called except for the circles which are hereinafter referred to as cylinders 28 for the sake of clarity.

The rules generally provide for the men of one set, for example the black set, to be disposed on intersection points 9A to J, outer circle 9 being the base or home line for black, and the white men on points 1A to J on the inner circle 1, the base or home line for white.

The next circles 8 and 2 form the piece lines for black and white main pieces respectively, the arrangement being such that the hexagons are on the A radius, the pentagons on B and J radii, the squares on C and H radii, the triangles on D and G radii and the cylinders on E and F radii.

The movement of the pieces is determined also in general terms as follows:

Men; a man can only advance towards the opponent's base or home line, one intersection point per move, along spirals or radii. Upon reaching the opponent's base line the man at the next move passes directly to its own base line, on the same or an adjacent radius; alternatively, the man may initiate an exchange or removal procedure concerning the main pieces, depending upon the nature of the game being played.

Main pieces; each main piece may move in any direction, including from its own base line directly to the opponent's base line, subject to the individual limitations on each move, for example:

Triangles; a triangle may move either two or three intersection points on any combination of paths, provided that it lands on a different radius and circle from those from which the move started. (See FIG. 2 wherein a triangle is shown with arrows in heavy lines indicating some possible moves).

Cylinders: a cylinder may move along any one of the radii or circles for up to five intersection points, but not along the spirals. (See FIG. 2).

Squares; a square may move only along any one of the spirals for up to five intersection points. (See FIG. 2).

Pentagons; a pentagon can move up to five intersection points along any one path.

Hexagon; each hexagon can move only one intersection point along any one path.

All pieces may move only along unobstructed paths.

In general a piece may be captured (removed from play) when it occupies an intersection point upon which a piece being moved lands at the end of its move.

The rules provide for several games to be played using the apparatus.

In a first game, hereinafter referred to as the "Taurus" game, the specific rules require all the pieces to be deployed as described, and the object of the game is to capture the opponent's hexagon.

In the game it is possible for a piece to capture another piece of the same side, but when such a capture is made the piece moved returns to the position from which it started the move, i.e., the captured piece is simply removed.

Also, in general, each man returning to its own base line after passing the opponent's base line may be exchanged for a main piece or may be removed together with an opponent's main piece selected by the player of the man concerned. However, the rules may allow for certain exceptions, in that if the opponent has two pentagons, one of the opponent's main pieces may be removed and one of the player's own main pieces restored to play, and in that no hexagon can be removed. If the opponent has only one pentagon, this may not be removed.

The game Taurus may be modified to include an element of chance, the modified game being called "Pentaurus". According to the rules in this game two dice 50 are used having faces numbered or charactered 0 to 5, and the player may elect to move any main piece, subject to the general rules aforesaid, by a number of intersection points equal to the character scored (in the normal way) by either of the dice or the difference between said scores. In the event of a double, the cast may be repeated at the option of the player, but if repeated only the said difference between the scores may be adopted. If a further repeat is elected and a double results or if at any time a double blank is scored the move is forfeit excent in that the player may move his hexagon if it is liable to capture upon the opponent's next move.

According to the rules in a further game, hereinafter called "Units", only the men are used and are disposed as aforesaid. The men are moved as previously described except in that when they reach their own base line after passing the opponent's base line, they are crowned, as in the game of draughts, and have the ability to move in any direction on any of the paths.

The game of Units may be modified to incorporate an element of chance by employing an ordinary die to determine the number of men which may be moved by the player at any given move.

The object of the game is to capture all the opponent's pieces, but the game may be terminated, preferably by agreement between the players, when only crowned men remain on the board if (a) both players agree that the capture of further men is no longer practical, of (b) if a predetermined number of moves, e.g., 16, have been made without a man being captured. The winner in such an event is the player with the most men in play, but if the sides are equal the result is a draw.

Figure 3:
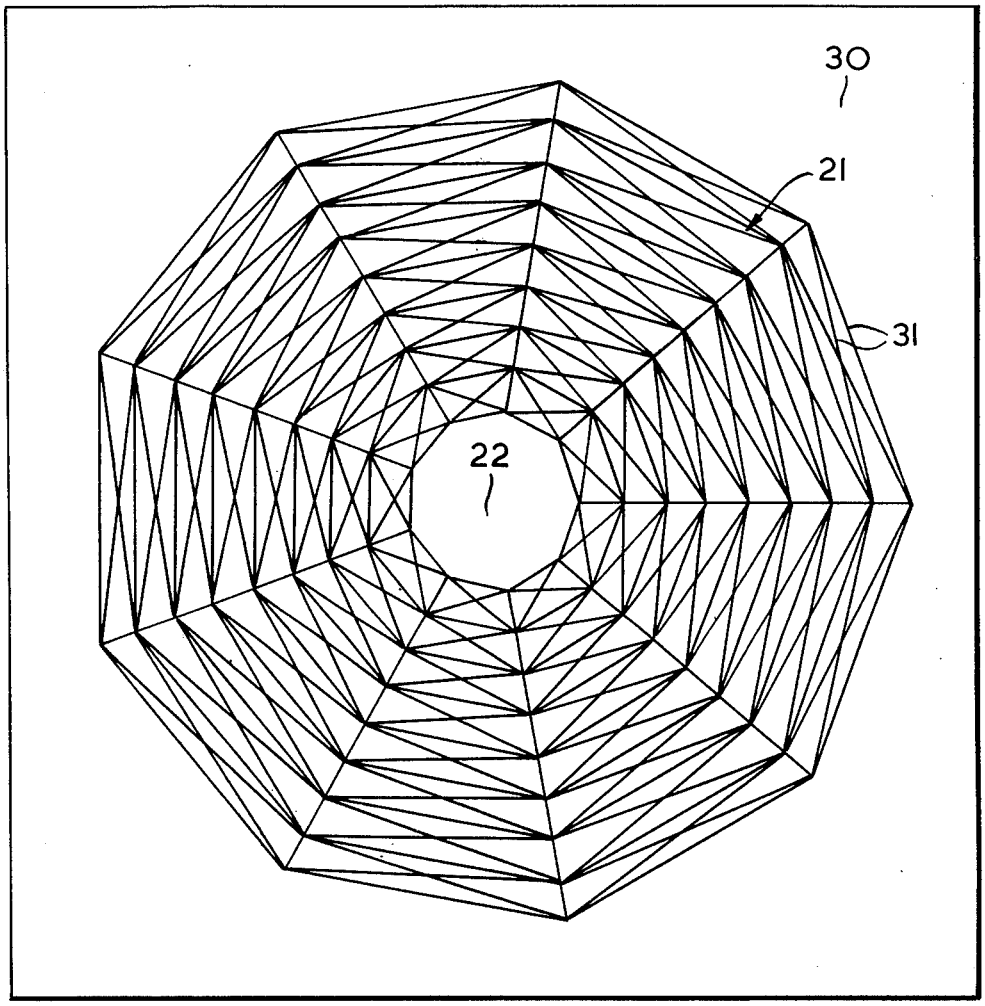
FIGS. 3 and 4 represent modified forms of boards.

In the alternative form of board shown in FIG. 3, the game and central zones 21, 22 are of regular nonagonal form, and the endless and oblique paths are made up of linear portions 31, but the direct paths are radial as in the board of FIG. 1. The boards of FIGS. 1 and 3 are clearly analogous, and the rules described herein are directly applicable to both boards.

Figure 4:
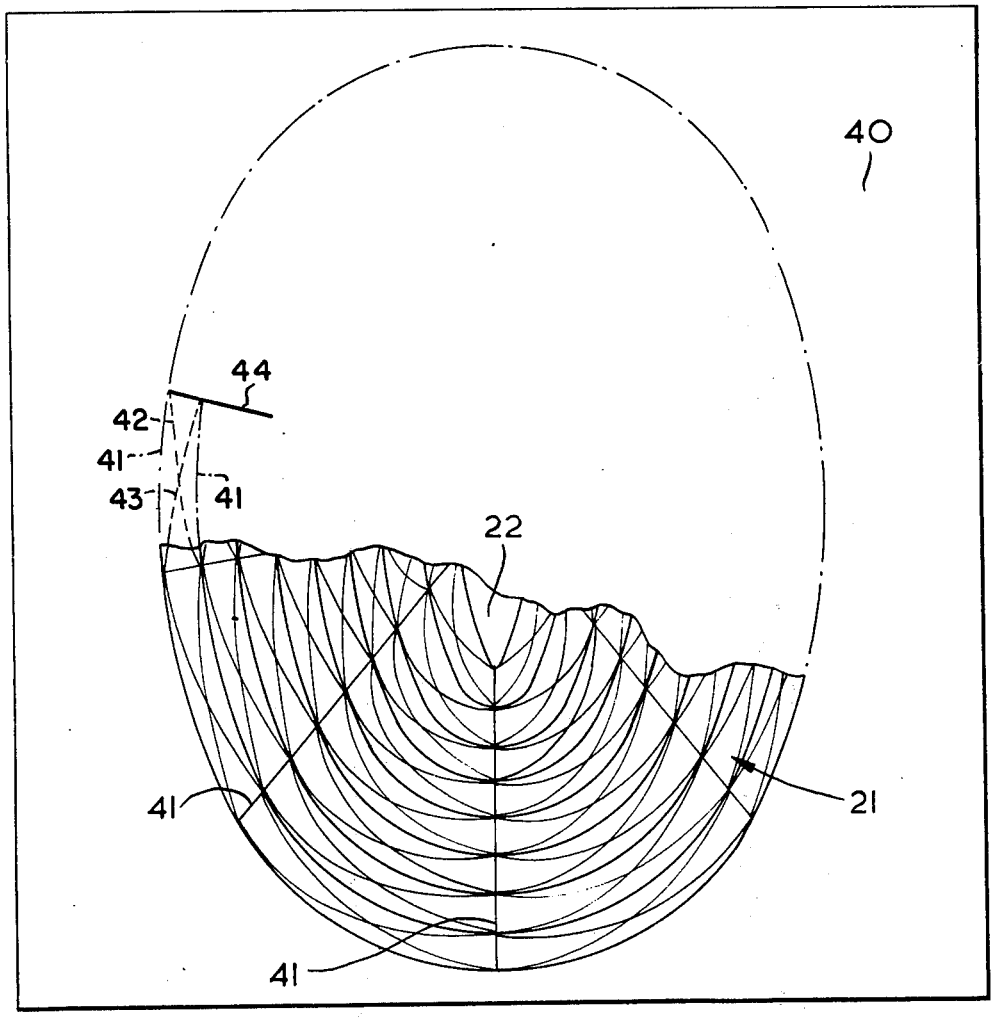

In the further modification shown in FIG. 4, the board 40 has elongate oval game and central zones 21, 22, the endless paths being likewise oval. The spacing between the direct paths 41 is varied to maintain a reasonable separation at the inner path. The board 40 is functionally similar to the boards 20 and 30 and the same rules are applicable.

In general, the paths are represented by lines in the drawings for the sake of simplicity and clarity, but the actual boards will be on a larger scale and will employ paths which are identifiable by selected visual characteristics, particularly, for example, color, shade, width density and pattern of marking e.g., as indicated at 41, 42, 43 and 44 in FIG. 4. Furthermore, the intersection points are preferably represented by areas e.g., 51 or 52 in FIG. 2, denoted by a selected characteristic, e.g., color, and of a size sufficient to enable any of the pieces to be placed thereon. The starting positions of the pieces may be indicated by representative outlines printed within the respective intersection points at said positions.

The invention is not confined to the foregoing details and many variations are possible within the scope of the invention as defined by the appended claims. For example, the board may have more or fewer paths, and more or fewer pieces may be employed. In the examples, the opposing main pieces are separated by a number of intersection points and are restricted in their maximum moves such that no capture of an opponent's piece is possible in the first move. It is preferred that an equivalent restriction should be applied to any modification of the board, men or rules.

The pieces may be varied in shape, as may be the rules concerning the movement of the pieces. For instance the triangles may move one or two intersection points along one set of paths and one or two intersection points along a different set, up to a total number of three intersection points, the sets of oblique paths, e.g., spirals, counting as one set in this instance only.

The rules may require a "Warning" to be given by a player to the opponent prior to a move, if the move involves a liability to capture of an opponent's piece, and if such a warning is not given the unwarned opponent may retreat his endangered piece or the player's next move may be forfeit, and the opponent may be required to give a warning if a player's move results in the player's hexagon or his single pentagon (if only one of his pentagons remains in play at the time) being endangered, whereupon the player may modify the move. If a warning is not given the opponent may be prohibited from taking the piece at the next move, or the player may retreat the endangered piece should the opponent attempt to take it.

The board may form part, e.g., a top, of a table, or part, e.g., a lid, of a container for storing the pieces.

We claim:

1. Apparatus comprising:
a) a board and pieces;
b) the pieces comprising two differently colored sets;
c) the board comprising a game zone having paths defined thereon, and a central zone within the game zone;
d) said paths including a set of at least five endless paths in an expanding series from an inner endless path of the series to an outer endless path of the series, a set of at least five direct paths which extend directly outwards from said inner endless path to said outer endless path so that points of intersection are defined whereat said direct paths intersect the endless paths, and a set of at least five oblique paths each of which extends obliquely outwards beginning at one of said points of intersection between said inner endless path and a direct path to one of said points of intersection between said outer endless path and a direct path to link all said endless paths with an equal number of direct paths at respective points of intersection;
e. said oblique paths extending outwardly to successive points of intersection between the endless paths and the direct paths;
f. the paths being such as to permit the pieces to be placed at or on points of intersection whereby to permit a game to be played according to rules for moving the pieces.

2. Apparatus as claimed in claim 1 including
a second set of oblique paths,
the oblique paths of one set extending outwardly clockwise and the oblique paths of the other set extending outwardly anticlockwise,
said oblique paths of each set extending outwardly to successive points of intersection between the endless paths and the direct paths.

3. Apparatus as claimed in claim 1 wherein
the number of paths in each set is identical.

4. Apparatus as claimed in claim 1 wherein
the interpath spacing between paths of each set is similar so that the game zone is symmetrical.

5. Apparatus as claimed in claim 1 wherein
some of the interpath spacings between paths of one or more of the sets are varied so that the game zone is elongate.

6. Apparatus as claimed in claim 1 wherein
the number of paths in each set is between 6 and 11, and
the paths of each set are distinguished from the paths of each other set by visual characteristics, and
the intersection points are each represented by an area sufficient to enable one of said pieces to be placed thereon.

7. Apparatus as claimed in claim 1 wherein
each set of pieces includes several identical men.

8. Apparatus as claimed in claim 1 wherein
each set of pieces includes several differently charactered main pieces.

9. Apparatus as claimed in claim 1 wherein
the board has represented thereon a further endless path around the game zone to represent a repetition of the inner path.

10. Apparatus as claimed in claim 1 including
dice or other means to determine a random number, for determining the number of pieces which may be moved or the number of intersection points by which a piece may be moved in any one move or turn.

11. Game apparatus comprising:
a. a board and pieces;
b. the pieces comprising two differently colored sets;
c. the board comprising a game zone having paths defined thereon, and a central zone within the game zone;
d. said paths including a set of at least five endless paths in an expanding concentric series from an inner endless path of the series to an outer endless path of the series, a set of at least five direct paths which extend directly outwards from said inner endless path to said outer endless path so that points of intersection are defined whereat said direct paths intersect the endless paths, and a set of at least five oblique paths each of which begins at one of said points of intersection between one of said direct paths and said inner endless path and extends outwards in a spiral manner to intersect each of the other endless paths and each other direct path at successive points of intersection;
e. the paths being such as to permit the pieces to be placed at or on points of intersection whereby to permit a game to be played according to rules for moving the pieces.

12. Game apparatus as claimed in claim 11 including
a second set of oblique paths,
the oblique paths of one set extending outwardly clockwise and the oblique paths of the other set extending outwardly anticlockwise.

13. Game apparatus as claimed in claim 12 wherein
the number of paths in each set is identical.

14. Game apparatus as claimed in claim 13 wherein the interpath spacing between paths of each set is similar so that the game zone is symmetrical.

15. Game apparatus as claimed in claim 13 wherein some of the interpath spacings between paths of one or more of the sets are varied so that the game zone is elongate.

16. Game apparatus as claimed in claim 12 wherein the number of paths in each set is between 6 and 11, and the paths of each set are distinguished from the paths of each other set by visual characteristics, and the intersection points are each represented by an area sufficient to enable one of said pieces to be placed thereon.

17. Game apparatus as claimed in claim 12 wherein each set of pieces includes several identical men.

18. Game apparatus as defined in claim 17 wherein each set of pieces includes several differently charactered main pieces.

19. Game apparatus as defined in claim 12 wherein the board has represented thereon a further endless path around the game zone to represent a repetition of the inner path.

20. Game apparatus as claimed in claim 1 including dice having faces charactered 0 to 5 to determine a random number for determining the number of pieces which may be moved or the number of intersection points by which a piece may be moved in any one move or turn.

* * * * *